United States Patent [19]

Bühler

[11] 4,263,469

[45] Apr. 21, 1981

[54] ROLLER CRADLE OF AN INHERENTLY STABLE FURNACE

[75] Inventor: Karl Bühler, Nussbaumen, Switzerland

[73] Assignee: BBC Brown, Boveri & Company Limited, Baden, Switzerland

[21] Appl. No.: 73,018

[22] Filed: Sep. 6, 1979

[30] Foreign Application Priority Data

Sep. 28, 1978 [CH] Switzerland ..... 10119/78

[51] Int. Cl.[3] ..... F27D 3/14

[52] U.S. Cl. ..... 13/10

[58] Field of Search ..... 13/10; 222/604

[56] References Cited

U.S. PATENT DOCUMENTS

| | | | |
|---|---|---|---|
| 1,671,026 | 5/1928 | Gage | 13/10 |
| 2,908,737 | 10/1959 | Dominicis | 13/10 |
| 3,173,980 | 3/1965 | Hysinger | 13/10 X |
| 3,835,231 | 9/1974 | Marchner | 13/10 |

*Primary Examiner*—Roy N. Envall, Jr.

*Attorney, Agent, or Firm*—Burns, Doane, Swecker & Mathis

[57] ABSTRACT

A roller cradle of an inherently stable furnace comprises a contact surface whose rest portion has a curvature which is less than that of the remaining contact surface portions. The rest portion is preferentially flat and the remaining portions are of involute form. The geometry of the roller cradle is such as to provide an approximately constant restoring moment. Sufficient restoring moment is ensured in the case of small tilt angles.

13 Claims, 7 Drawing Figures

ROLLER CRADLE OF AN INHERENTLY STABLE FURNACE

BACKGROUND AND OBJECTS OF THE INVENTION

The present invention relates to furnaces, such as electric arc furnaces.

Furnaces, for example electric arc furnaces, must be tipped for pouring or drawing off the slag. The furnace pot rests in this case on roller cradles which are usually circular to define rotary arcs which customarily roll on flat movable beams. A form of construction such as this is contained, for example, in French Pat. No. 2,113,198. Furnaces now being built are of the "inherently stable" type, i.e., those to a central position independently following each tilt. This is accomplished by arranging the center of the rotary arc above the furnace center of gravity. The furnaces of this type feature a higher operational reliability than those which tip by their own weight into the slag-removal position.

The amount of the restoring moment must be taken into consideration in the design of an inherently stable furnace. This amount is not constant and is a function of the instanteous tilt angle. The restoring moment is maximum in the forward or pouring position. When the furnace thereafter tilts rearwardly, the restoring moment becomes smaller until it is equal to zero in the center or rest position. In order to achieve a sufficiently large restoring moment when small tilt angles are involved, the practice has been to increase the distance or moment arm betweeen the center of gravity and the center of the rotary arc. However, with a solution of this type, the tilt drive must overcome an undesirably great restoring moment. Thus, the means of propulsion, e.g., hydraulic cylinders, must be suitably designed for increased output, and the rolling path becomes larger. In the case of electric arc furnaces, with this form of construction, the power cables must always be longer, whereby the impedance to the power supply is increased.

An object of this invention is to avoid such disadvantages.

Another object is to produce a roller cradle for an inherently stable furnace which ensures a sufficient restoring moment in connection with small tilt angles.

The invention should also enable at least an approximately constant prescribed moment development during tilting and the furnace should be highly stable in the center position.

SUMMARY OF THE INVENTION

These objects are achieved in accordance with the invention by a roller cradle of an inherently stable furnace, in that an intermediate or rest portion (generally a central portion) of the contact surface of the roller cradle possesses a smaller curvature than the remaining contact surfaces of the roller cradle.

More particularly, an advantage of the invention involves the fact that the intermediate contact surface of the roller cradle constructed with such smaller curvature stabilizes the rest or center position of the furnace and enables the remaining contact surfaces to be made shorter and with such curvature that a sufficient restoring moment is ensured even in the case of small tilt angles.

In one embodiment of the invention the rest portion of the contact surface is flat (i.e., the curvature equals zero). In this form of construction, the pressure of the furnace is distributed over a relatively large surface.

In another embodiment, the rest portion of the contact surface possesses a negative curvature, i.e., it is curved upward. In this case, only the border zones of the rest contact surface are supported on the movable beams. This location is quite stable even in the case of the presence of outside undesired objects, more particularly slags, on the movable beams.

A similar advantage results from another embodiment wherein the rest portion of the contact surface of the roller cradle is formed by the ends of the forward and rear contact surfaces with an empty space between them. Preferably, the length (L) of the rest portion of the contact surface is equal in the rolling direction to twice the quotient of the desired minimum restoring moment (M) and the average furnace weight (W), increased by the amount (A) by which the center of gravity can be shifted horizontally, i.e., $L=2(M/W)+A$. As is well known, there results a moment arm by displacing the point of support of the furnace on the movable beams away from alignment with the vertical line of application of the furnace weight extending through the center of gravity. A resultant restoring moment is equal to the horizontal distance of the shift multiplied by the furnace weight.

In the case of a furnace, e.g., an electric arc furnace, both the weight as well as the location of the center of gravity can vary within certain limits. This occurs during pouring as a result of the wear of the brick lining and the lid and, in the case of an electric arc furnace, also as a result of the varying level of electrodes and their leadins. There are nevertheless values to be determined for each furnace, from which values and from the desired minimum restoring moment the length of the at-rest contact surface of the roller cradle can be determined.

It is preferable that the forward contact surface of the roller cradle and/or the rear contact surface of the roller cradle be of involute form. This involute form enables a constant or at least an approximately constant restoring moment to be achieved because the radius of the curvature of the forward contact surface can be made to progressively decrease as the furnace is tilted from the at-rest position. It will be appreciated that the point of application of the center of gravity features the same distance theoretically in each tilt situation, with the exception of the at-rest portion of the contact surface where at least two contact points are present. In reality, the location of the center of gravity is changed but the changes are nevertheless not great and a precisely constant restoring torque is also unnecessary.

If desired, the contact surfaces may be shaped as the involute of a circle, whereby the radius of the circle equals the quotient of the desired minimum restoring moment and the average furnace weight, increased by one-half of the amount by which the center of gravity can be shifted horizontally. This form of construction enables a selection of the desired restoring moment.

According to a further embodiment, the forward and/or rear contact surface portions are constructed in circular segment form. This solution simplifies the design of the roller cradle. The length of the circular roller cradle is nevertheless greater than the one with the involute form so that one of the advantages of the invention does not result from this embodiment.

According to another embodiment, the center points of the circle segments of the forward contact surface and of the rear contact surface are located on imaginary verticals projecting from the intersections of the front and rest surface portions with the center portion. This feature enables an approximately constant minimum restoring moment to be provided.

THE DRAWING

The invention is explained more in detail on the basis of preferred embodiments thereof in the accompanying drawing in which.

DETAILED DESCRIPTION OF PREFERRED EMBODIMENTS OF THE INVENTION

Figure 1:
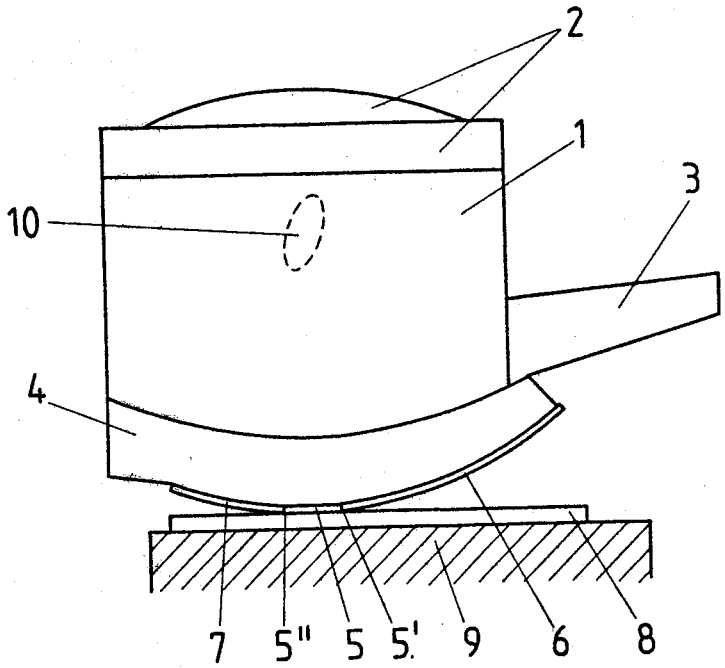
FIG. 1 is a side elevational view of an inherently stable furnace with a roller cradle according to one embodiment of the invention.

According to FIG. 1, a furnace pot 1 having a furnace lid 2 and a pouring lip 3 is disposed on a roller cradle 4 of which only the right-hand half can be seen. The roller cradle 4 includes a contact surface, the rest or so-called "center" portion 5 of which is flat. This flat rest portion 5 of the contact surface includes front and rear ends 5' and 5''. The rest portion 5 of the contact surface is connected with a forward portion 6 of the contact surface or produced integrally with it in one piece. The rest portion 5 of the contact surface is generally tangent to the forward portion 6 of the contact surface. The cradle also includes a rear portion 7 of the contact surface connected to or made integrally in one-piece with the center surface 5.

The forward contact surface portion 6 and the rear contact surface portion 7 are of involute form, whereby the length of the radius of curvature thereof continuously varies. The longest radius is adjacent the at-rest portion 5 and decreases to a shortest radius remote from the rest portion 5. In its rest position the furnace pot is supported by the rest portion 5. The center of curvature of the surface portion 6, 7 lies generally vertically above the center of gravity, located in a zone 10.

The roller cradle 4 is supported on movable beams 8 which are attached to a base 9.

All design features not required for a direct understanding of the invention, for example, the elements for securing the opposite location of the roller cradle 4 and of movable beams 8, can be conventional and have been omitted from this description.

Figure 2:
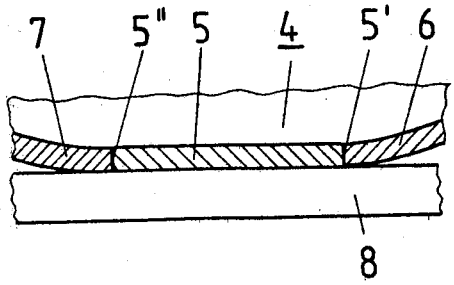
FIG. 2 is a detail of FIG. 1 of a flat rest portion of a contact surface of the roller cradle.

A detail from FIG. 1 is shown in FIG. 2. The same parts are provided with the same reference numbers in all drawings. The center flat contact surface 5 provides for a uniform distribution of the pressure between this contact surface 5 and movable beam 8 and is highly stable. The forward contact surface 6 and the rear contact surface 7 are produced in involute form.

The rest portion 5 thus defines a curvature which is zero and is thus less than that of the remaining portions 6, 7 of the contact surface. Such relationship need not be formed by a flat rest surface 5, but by other configurations as will become apparent from the following.

Figure 3:
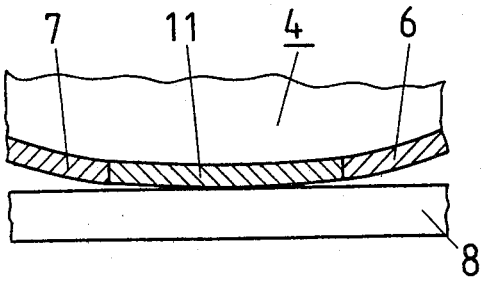
FIG. 3 is a view of another embodiment of the invention wherein the rest portion of the contact surface is slightly curved.

According to the embodiment of FIG. 3, a center contact surface 11 is curved sightly downward whereby this curvature is nevertheless essentially less than that of the contact surfaces 6, 7.

Figure 4:
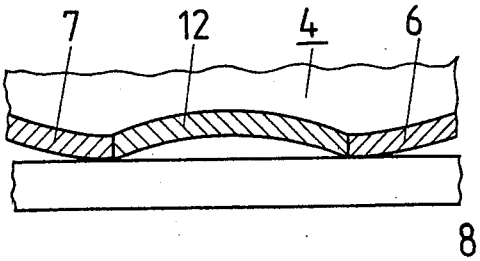
FIG. 4 is a view of another embodiment wherein the rest portion of the contact surface is negatively curved.
Figure 5:
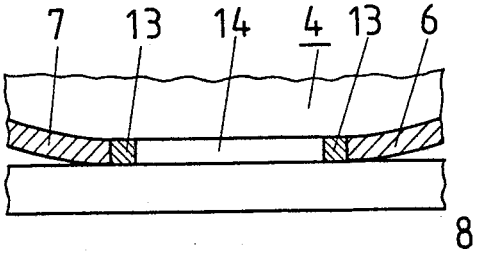
FIG. 5 is a view of another embodiment wherein the rest portion of the contact surface is defined by two end parts of the outside contact surfaces with an empty space between them.

FIG. 4 shows an embodiment wherein a center negatively curved contact surface 13 is provided and which is thus less than the positive curvatures of portions 6, 7. According to an embodiment of FIG. 5, the center contact surface is defined by two parallel strips 13 at the ends of portions 5, 6 between which there is an empty space.

Figure 6:
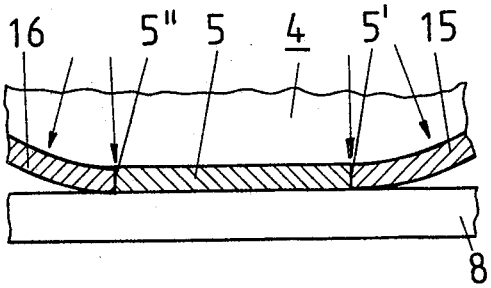
FIG. 6 is a view of another embodiment wherein the contact surfaces are constructed in circle segment form.

The embodiments according to FIG. 6 involves the flat center contact surface 5 as in FIGS. 1 and 2. A forward contact surface 15 and a rear contact surface 16 are produced in circular segment form. The radius of the forward contact surface 15 is greater than that of the rear contact surface 16. The radii are designated by arrows. From the arrows, which point to the ends 5' and 5'' of the center contact surface, it can be seen that the center of rotation of each of the contact surfaces 15 and 16 is located on a vertical line at an end of the center surface 5' or 5''.

Figure 7:
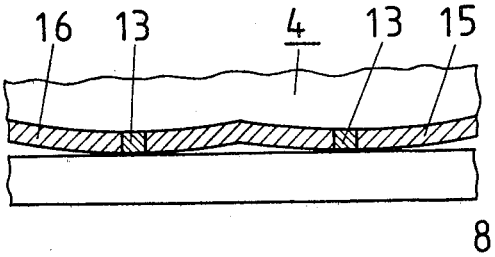
FIG. 7 is a view of another embodiment wherein the rest portion of the contact surface is formed by two end parts of the outside contact surfaces.

In the embodiment according to FIG. 7, the forward contact surface 15 is produced in one-piece with the rear contact surface 16 and is deformed at the center to form a central surface portion having "ends" 13 designated by cross-hatching opposite that of the one-piece sections 15, 16. The ends 3 of the two contact surfaces 15 and 16 are supported in the "rest" position on the movable beams 8.

An advantage of the invention involves the fact that the intermediate contact surface of the roller cradle constructed with a smaller curvature stabilizes the rest or center position of the furnace and enables the remaining contact surfaces to be made shorter and with such curvature that a sufficient restoring moment is ensured even in the case of small tilt angles.

Preferably, the length (L) of the rest portion of the contact surface is equal in the roller direction to twice the quotient of the desired minimum restoring moment (M) and the average furnace weight (W), increased by the amount (A) by which the center of gravity can be shifted horizontally, i.e., $L=2(M/W)+A$. As is well known, there results a moment arm by displacing the point of support of the furnace on the movable beams away from alignment with the vertical line of application of the furnace weight extending through the center of gravity. A resultant restoring moment is equal to the horizontal distance of the shift multiplied by the furance weight.

In the case of a furnace, e.g., an electric arc furnace, both the weight as well as the location of the center of gravity can vary within certain limits. This occurs during pouring as a result of the wear of the brick lining and the lid and, in the case of an electric arc furnace, also as a result of the varying level of electrodes and their leadins. There are nevertheless values to be determined for each furnace, from which values and from the desired minimum restoring moment the length of the at-rest contact surface of the roller cradle can be determined.

It is preferable that the forward contact surface of the roller cradle and/or the rear contact surface of the roller cradle be of involute form. This involute form enables a constant or at least an approximately constant restoring moment to be achieved because the radius of the curvature of surface 6 can be made to progressively decrease as the furnace is tilted from the at-rest position. It will be appreciated that the point of application of the center of gravity features the same distance theoretically in each tilt situation, with the exception of the at-rest portion of the contact surface where at least two contact points are present. In reality, the location of the center of gravity is changed but the changes are nevertheless not great and a precisely constant restoring torque is also unnecessary.

If desired, the contact surfaces may be shaped as the involute of a circle, wherein the radius of the circle equals the quotient of the desired minimum restoring moment and the average furnace weight, increased by one-half of the amount by which the center of gravity can be shifted horizontally. This form of construction enables a selection of the desired restoring moment.

According to a further embodiment, the forward and/or rear contact surface portions are constructed in circular segment form. This solution simplifies the design of the roller cradle. The length of the circular roller cradle is nevertheless greater than the one with the involute form so that one of the advantages of the invention does not result from this embodiment.

Although the invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A roller cradle of a slag furnace of the beam inherently stable type which rolls on a movable beam, comprising a contact surface which engages the movable beam and which includes a rest portion intermediate the ends of the cradle, said rest portion defining a smaller curvature of roll than remaining portions of said contact surface and being curved in negative relationship to the movable beam, said remaining portions being curved in positive relationship to the beam, the length of said rest portion, in the direction of roll, being equal to twice the quotient of the minimum restoring moment and the average furnace weight, increased by the length by which the center of gravity can be shifted horizontally.

2. Apparatus according to claim 1, wherein said rest portion is flat.

3. Apparatus according to claim 1, wherein ends of said rest portion are defined by opposite ends of said remaining portions, between which ends there is empty space.

4. Apparatus according to claim 1, wherein that part of said remaining portions which is located forwardly of said rest portion is shaped as an involute.

5. Apparatus according to claim 1, wherein that part of said remaining portions which is located rearwardly of said rest portion is shaped as an involute.

6. Apparatus according to claim 1, wherein said remaining portions define the involute of a circle, the length of the radius thereof being equal to the quotient of the minimum restoring moment and average furnace weight increased by one-half the amount by which the center of gravity can shift horizontally.

7. Apparatus according to claim 1, wherein that part of said remaining portions which is located forwardly of said rest portion is shaped as a circular segment.

8. Apparatus according to claim 1, wherein that part of said remaining portions which is located rearwardly of said rest portion is shaped as a circular segment.

9. Apparatus according to claim 8, wherein that part of said remaining portions which is located forwardly of said rest portion is shaped as a circular segment.

10. Apparatus according to claim 9, wherein the centers of said circular segments are respectively located on imaginary vertical lines passing through the contact points of said remaining portions and said rest portion.

11. A roller cradle of a slag furnace of the inherently stable type which rolls on a movable beam, comprising a contact surface which engages the movable beam and which includes a rest portion intermediate the ends of the cradle, said rest portion defining a smaller curvature of roll than remaining portions of said contact surface, that part of said remaining portions located rearwardly of said rest portion being shaped as an involute, the length of said rest portion, in the direction of roll, equals twice the quotient of the minimum restoring moment and the average furnace weight, increased by the length by which the center of gravity can be shifted horizontally.

12. A roller cradle of a slag furnace of the inherently stable type which rolls on a movable beam, comprising a contact surface which engages the movable beam and which includes a rest portion intermediate the ends of the cradle, said rest portion defining a smaller curvature of roll than remaining portions of said contact surface, that part of said remaining portions which is located forwardly of said rest portion is shaped as the involute of a circle, the length of the radius thereof being equal to the quotient of the minimum restoring moment and average furnace weight increased by one-half the amount by which the center of gravity can shift horizontally.

13. A roller cradle of a slag furnace of the inherently stable type which rolls on a movable beam, comprising a contact surface which engages the movable beam and which includes a rest portion intermediate the ends of the cradle, said rest portion defining a smaller curvature of roll than remaining portions of said contact surface, that part of said remaining portions which is located rearwardly of said rest portion is shaped as the involute of a circle, the length of the radius thereof being equal to the quotient of the minimum restoring moment and average furnace weight increased by one-half the amount by which the center of gravity can shift horizontally.

* * * * *